US012196049B2

(12) United States Patent
Nesheim

(10) Patent No.: US 12,196,049 B2
(45) Date of Patent: Jan. 14, 2025

(54) PRESSURE RELEASE DURING DRILLING

(71) Applicant: CONOCOPHILLIPS COMPANY, Houston, TX (US)

(72) Inventor: Gunvald Nesheim, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/166,632

(22) Filed: Feb. 3, 2021

(65) Prior Publication Data

US 2021/0246744 A1 Aug. 12, 2021

Related U.S. Application Data

(60) Provisional application No. 62/972,307, filed on Feb. 10, 2020.

(51) Int. Cl.
*E21B 21/10* (2006.01)
*E21B 21/08* (2006.01)

(52) U.S. Cl.
CPC ..... *E21B 21/103* (2013.01); *E21B 21/08* (2013.01)

(58) Field of Classification Search
CPC ..... E21B 21/103; E21B 21/08
See application file for complete search history.

(56) References Cited

U.S. PATENT DOCUMENTS 2,786,652 A 3/1957 Wells
2,946,565 A 7/1960 Williams
4,361,193 A * 11/1982 Gravley ..... E21B 41/0078 175/320
4,537,258 A * 8/1985 Beck ..... E21B 49/001 166/374
7,395,877 B2 * 7/2008 Hosie ..... E21B 21/10 175/25
2004/0069504 A1 4/2004 Krueger
2004/0079553 A1 4/2004 Livingstone
2008/0099246 A1 5/2008 Sihler
2009/0272580 A1 * 11/2009 Dolman ..... E21B 34/08 175/48
2015/0144360 A1 5/2015 Shearer
2015/0226012 A1 8/2015 Zhou
(Continued)

FOREIGN PATENT DOCUMENTS

GB 2431942 A 5/2007

OTHER PUBLICATIONS

International Search Report and Written Opinion for PCT/US2021/016405 mailed Jun. 3, 2021; 12 pgs.

*Primary Examiner* — Brad Harcourt
(74) *Attorney, Agent, or Firm* — CONOCOPHILLIPS COMPANY

(57) ABSTRACT

The invention relates to the drilling of wells in rock and hydrocarbon formations. Drilling is performed with a drill string having a bottom hole assembly (BHA) and drill bit. Drilling mud is circulated during drilling. A valved inlet port is provided in the BHA which, in the event of a pack-off, opens and allows drilling mud to enter an internal space in the BHA to relieve pressure. An outlet port at the proximal end of the BHA may be provided to allow the mud to flow back into the annulus around the drill string. In this way, rapid build-up of pressure is avoided and the driller has more time to respond to the pack-off.

3 Claims, 3 Drawing Sheets

(56) References Cited

U.S. PATENT DOCUMENTS

| | | | | |
|---|---|---|---|---|
| 2015/0233197 | A1* | 8/2015 | Oy | E21B 21/10 700/282 |
| 2015/0345240 | A1* | 12/2015 | Roders | E21B 21/103 175/48 |
| 2018/0045002 | A1* | 2/2018 | Riise | E21B 47/06 |

* cited by examiner

PRESSURE RELEASE DURING DRILLING

CROSS-REFERENCE TO RELATED APPLICATIONS

This application is a non-provisional application which claims benefit under 35 USC § 119 (e) to U.S. Provisional Application Ser. No. 62/972,307 filed Feb. 10, 2020 entitled "PRESSURE RELEASE DURING DRILLING," which is incorporated herein in its entirety.

STATEMENT REGARDING FEDERALLY SPONSORED RESEARCH

None.

FIELD OF THE INVENTION

This invention relates to drilling into rock formations, for example into hydrocarbon-bearing rock formations.

BACKGROUND OF THE INVENTION

In the process of drilling a well in rock, commonly a hollow drill string is employed. At the distal end of the drill string is a so-called bottom hole assembly comprising various pieces of equipment, with a drill bit located at the extreme distal end. The bottom hole assembly ("BHA") normally has a diameter somewhat larger than the drill string, and the drill bit has a still larger diameter. As the wellbore is drilled, an annular space is therefore created between the BHA and the rock formation, and a somewhat larger annular space created between the drill pipe and the formation.

Drilling mud is circulated down through the hollow drill pipe and BHA, out through the drill bit and back up to the surface through the annular space between the drill pipe and the rock formation. Drilling mud has a number of functions, including lubricating the drill bit and carrying rock cuttings up to the surface.

When drilling, occasionally mud and rock cuttings can become compacted in the annular space, most commonly around the BHA since the annulus is smaller, forming a plug which prevents circulation of mud. This can happen very suddenly and is referred to as a pack-off. If mud continues to be pumped from the surface, this can lead to mud entering the porous rock formation, overcoming the natural pressure in the formation (so-called "formation pressure"). This situation is referred to as "lost circulation" and is highly undesirable for many reasons. In addition to the loss of drilling fluid, there will be lost productive time and there may be issues with the control of the well.

A pack-off like this can also cause the formation to become unstable due to fractures in the formation being initiated. This again leads to a lot of non-productive time.

Mud loss to formation is a major contributor to non-productive time. It takes a lot of time to recover from a mud loss situation. Sometimes recovery is not possible at all, which means the section will have to be re-drilled.

The normal way to mitigate or avoid these problems is for the driller to spot increased pressure caused by a pack-off starting to form and reduce the flow of mud. However, this has to be done fast to avoid the pack-off, and often the driller is unable to react in time.

There is therefore a need for a system, apparatus or methodology which will mitigate the problem of pack-offs during drilling.

BRIEF SUMMARY OF THE DISCLOSURE

In an embodiment, a bottom hole assembly is provided for use in drilling a bore in a rock formation, e.g. a hydrocarbon bearing rock formation, the assembly comprising a generally cylindrical body having a distal and a proximal end and an internal cavity, a drill bit located at the distal end, a connection for a drill pipe at the proximal end, an inlet port communicating between the cavity and an exterior of the cylindrical body and an inlet valve associated with the inlet port. The inlet valve is arranged to open at either or both of a specified pressure difference between the cavity and the exterior of the body or a specified rate of increase of pressure difference between the cavity and the exterior of the body. An outlet port may be provided, communicating between the cavity and an exterior of the cylindrical body and located proximally in relation to the inlet port, whereby the cavity forms a channel between the inlet and outlet ports. The outlet port may have a one-way valve.

The inlet valve may be arranged to open at a pressure difference between the cavity and the exterior of the body of 10 to 1000 psi (69 kPa to 6,900 kPa) greater than an expected maximum normal pressure, optionally 30 to 500 psi (210 to 3,400 kPa greater, such as 50 to 200 psi (340 to 1,400 kPa greater, e.g. about 100 psi (690 kPa) greater.

In another embodiment, a method of drilling into a rock formation comprises passing into the rock formation a drill string comprising a drill pipe, bottom hole assembly and drill bit, and thereby forming a wellbore in the rock formation, circulating drilling mud through the drill pipe, through a first channel in the bottom hole assembly and drill bit and back through an annular space defined between the drill string and wellbore and, in the event of an obstruction, or pack-off, forming or beginning to form between the bottom hole assembly and wellbore, passing drilling mud into an internal cavity of the bottom hole assembly at a location distal to the obstruction, in order to relieve pressure. Drilling mud may be passed out of the cavity at a location proximal to the obstruction, whereby the mud passes into the annular space between drill string and wellbore at a location proximal to the obstruction.

The drilling mud may be passed into the cavity through an inlet valve in the bottom hole assembly in which case the inlet valve may be opened at a specified pressure of drilling mud distal of the said obstruction. The pressure may be from 10 to 1000 psi (69 kPa to 6,900 kPa) greater than an expected maximum normal pressure, optionally 30 to 500 psi (210 to 3,400 kPa greater, such as 50 to 200 psi (340 to 1,400 kPa greater, e.g. about 100 psi (690 kPa) greater.

Alternatively, or in addition, the inlet valve may open in response to a predetermined rate of increase of pressure of drilling mud distal of the said obstruction, or to a predetermined pattern of pressure characteristic of the imminent formation of a pack-off.

In another embodiment, a method of drilling into a rock formation comprises passing into the rock formation a drill string comprising a drill pipe, bottom hole assembly and drill bit, and thereby forming a wellbore in the rock formation, circulating drilling mud through the drill pipe, through a first channel in the bottom hole assembly and drill bit and back through an annular space defined between the drill string and wellbore and, in the event of an increase of pressure in the region of the bottom hole assembly above a predetermined maximum (indicative of a pack-off forming or having formed, or of the risk of a pack-off forming), or of a rate of increase of pressure in the region of the bottom hole assembly above a specified maximum (indicative of a pack-off forming or having formed, or of the risk of a pack-off forming), opening a valve of an inlet port in the bottom hole assembly to allow drilling mud to pass into a cavity within the bottom hole. Drilling mud may pass out of the cavity through an outlet port at a location proximal to the inlet port.

The specified maximum may be from 10 to 1000 psi (69 kPa to 6,900 kPa) greater than an expected maximum normal pressure, optionally 30 to 500 psi (210 to 3,400 kPa greater, such as 50 to 200 psi (340 to 1,400 kPa) greater, e.g. about 100 psi (690 kPa) greater.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the term "distal" means remote from the surface end of the drill string when it is in use, in terms of distance as measured along the drill string, or more remote from the surface relative to another part of the drill string (including BHA and drill bit). "Proximal" means near or nearer to the surface, as measured along the length of the drill string (including BHA and drill bit), when in use.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
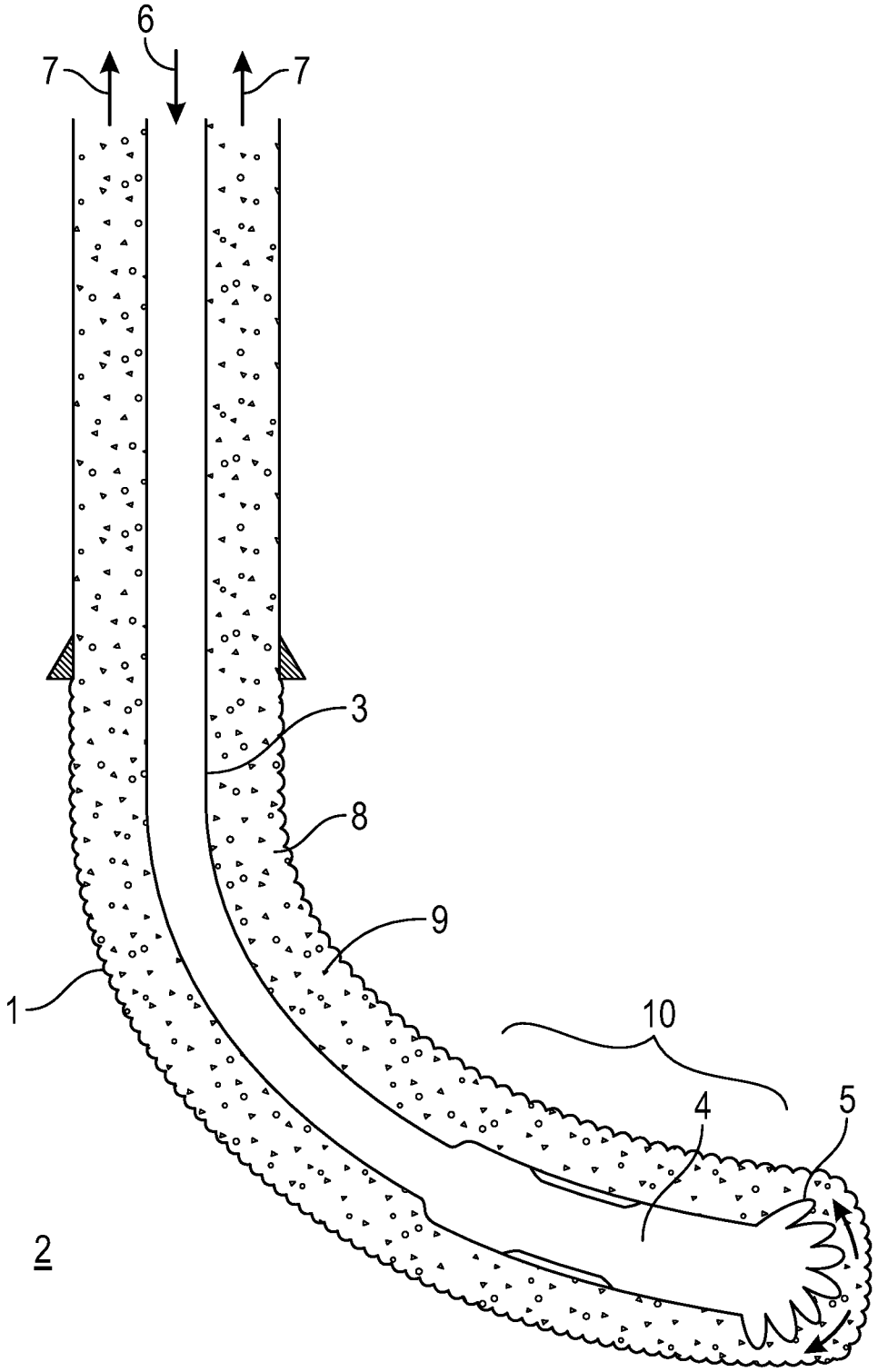
FIG. 1 is a schematic sectional drawing showing a wellbore with drill string including a conventional bottom hole assembly.
Figure 2:
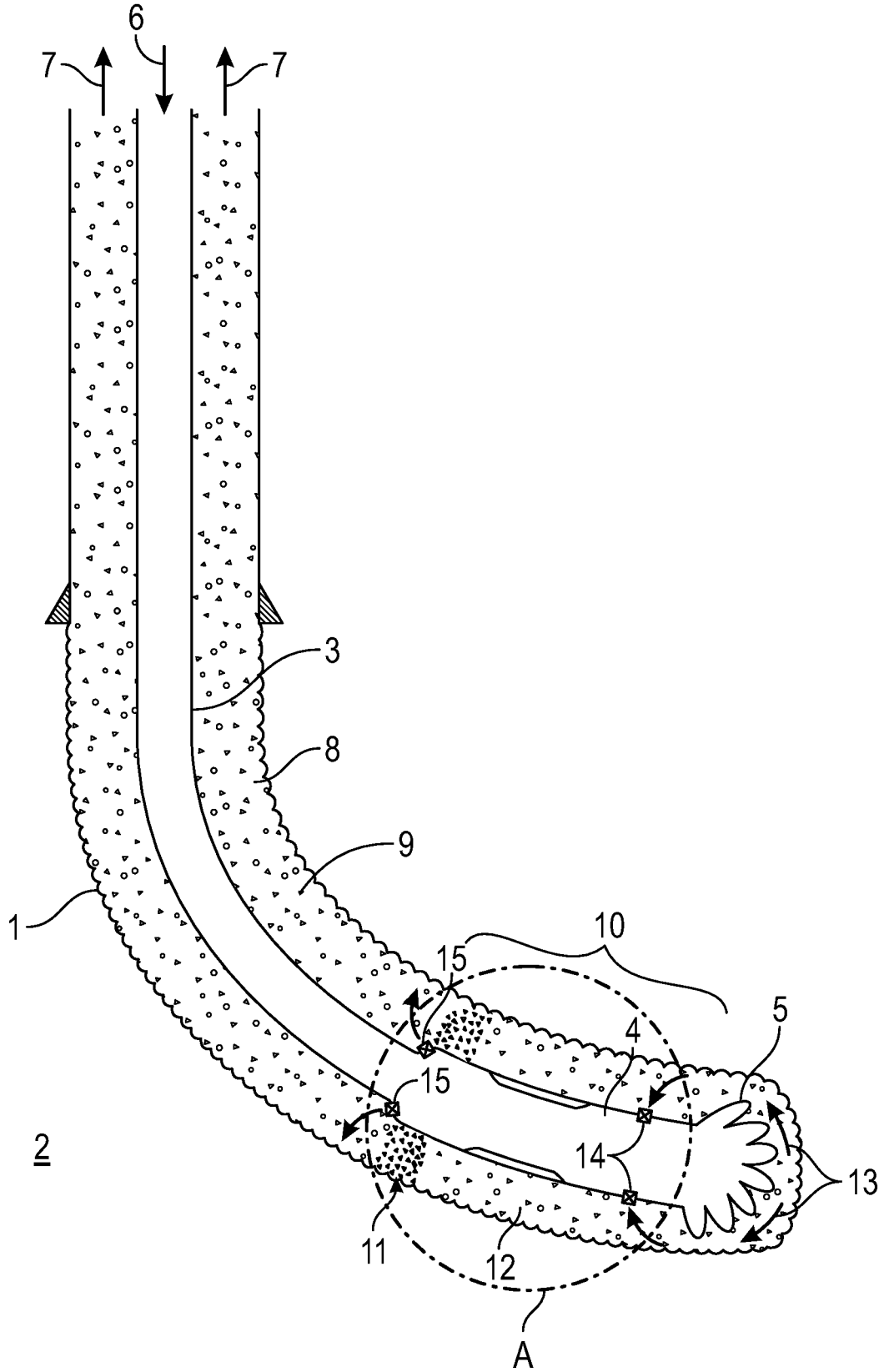
FIG. 2 is a view similar to FIG. 1 showing a bottom hole assembly according to the invention.

As shown in FIG. 1, a conventional drill string is shown creating a bore 1 in a rock formation 2. The drill string comprises drill pipe 3 and a bottom hole assembly, or BHA 4, terminating in a drill bit 5. Arrow 6 shows drilling mud entering the drill pipe at the proximal end (at the surface). Arrows 13 in FIG. 2 show the drilling mud emerging through the drill bit at the distal end of the drill string, to enter the annulus 8 in the narrower region 10 around the BHA 4. Returning mud flows through the annulus 8 and includes drill cuttings 9. The returning mud finally exits the proximal end of the annulus 8 at arrow 7.

FIG. 2 shows a drill string including a BHA according to the invention. Where parts correspond, the same reference numerals are used as for FIG. 1. In FIG. 2 a "pack-off" 11 is shown, comprising compacted drill cuttings and drilling mud in a region of the annulus around the proximal end of the BHA 4. Since mud is still being delivered under pressure into the pipe string at 6 and flowing through the drill bit at 13, pressure builds up rapidly in the annulus at 12. In a conventional drill string, this may result in mud overcoming the formation pressure and entering the rock formation 2.

Ports including one-way, pressure actuated valves 14 are provided towards the distal end of the BHA 4, proximal of the drill bit 5. Once a certain pressure is reached in the annulus at 12 (or a certain pressure difference is reached between the annulus and the interior of the BHA), the valves 14 open to allow passage of mud into the BHA. The mud is received in a cavity which is not shown in FIG. 2 but which is discussed in more detail below with reference to FIG. 3. The pressure or pressure difference at which the valves are designed to open can be set according to the drilling conditions, including the desired mud pressure. Expected drilling conditions can vary considerably between jobs and also between different phases of the same job or as drilling depth increases in any given drilling job. The valves 14 are designed to open at 100 psi (689 kPa) above the maximum expected normal mud pressure for the particular job, phase of job and/or drilling depth.

In an alternative embodiment, the valves 14 are design to open when they sense pressure increasing at above a certain rate which would indicate a pack-off occurring or to a pack-off beginning to occur or being likely to occur.

In a further alternative embodiment, a pressure pattern characteristic of an impending pack-off (somewhat like a "fingerprint") could also be used as activation mechanism.

Another option could be to have the two valves connected and the differential pressure between them being the activation mechanism, e.g. if the outlet valve senses 4,500 psi (31,000 kPa) in annulus and inlet valve senses 4,600 psi (31,700 kPa) then both valves open for bypass.

At the proximal end of the BHA 4, in a part of the wall of the BHA which faces generally axially with respect to the drill string and BHA, are exit ports and valves 15. The exit ports communicate with the inlet ports/valves 14 to allow mud to pass into the wider part of the annulus 8 proximal of the BHA 4. The ports 15 include one-way valves.

The arrangement described above allows mud to continue to circulate and avoid a build up of excessive pressure in the region 12 of the annulus around the BHA. The flow path for the mud is nevertheless more restricted than normal and there will be some pressure increase. This manageable increase in pressure can be detected at the surface and action taken to remedy the pack off, which would normally be the driller slowing down mud pumps to reduce the pressure and avoid losses.

The BHA cavity between inlet and outlet ports 14, 15 will be cleaned of drilling mud before operations commenced. This is done by reducing pressure, opening the valves and allowing the cavity to drain. A flush with a high pressure gun could alternatively be carried out.

Figure 3:
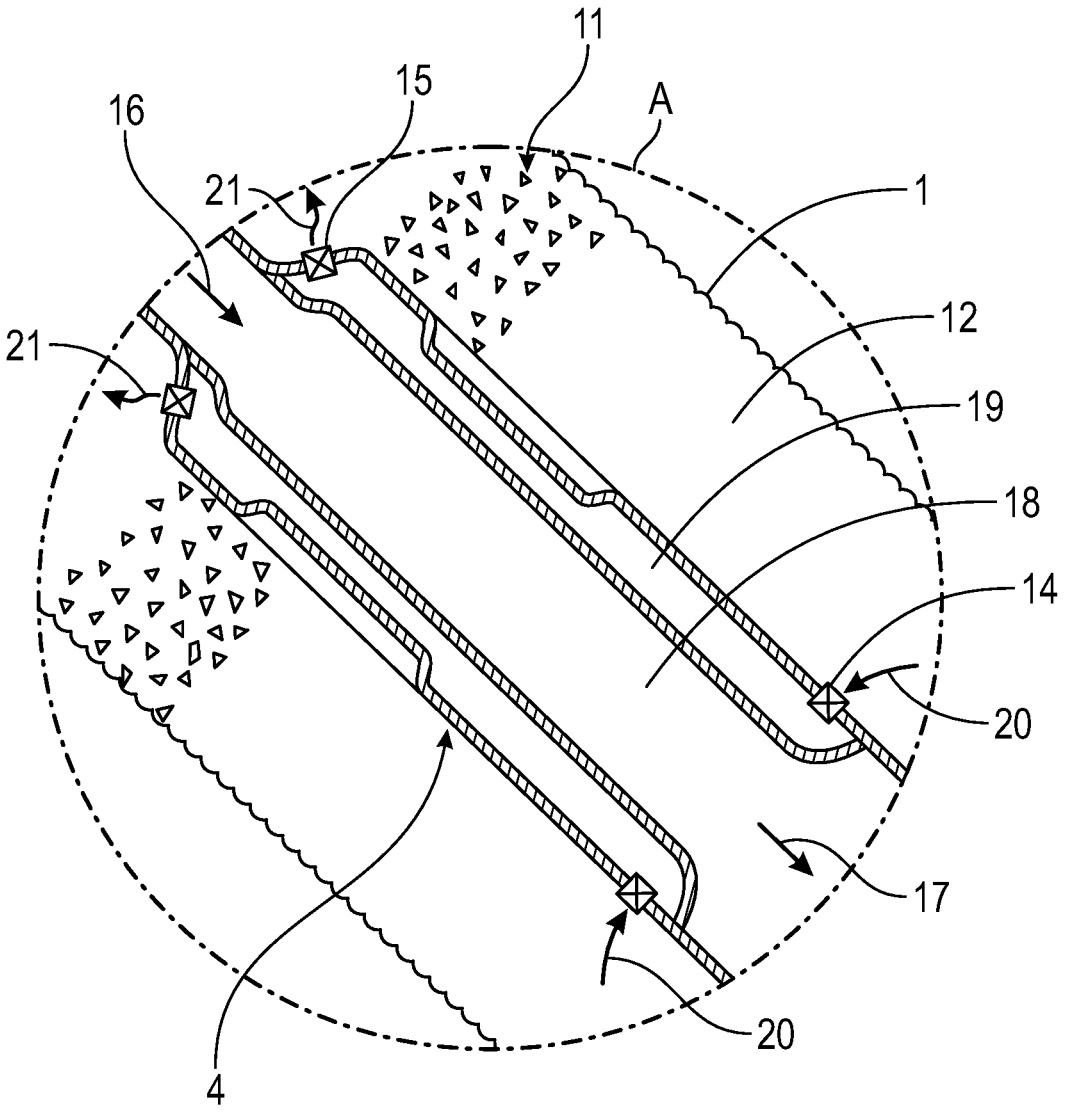
FIG. 3 is a detail from FIG. 2.

FIG. 3 shows detail A from FIG. 2, illustrating more internal structure of the BHA 4. Similar parts to FIGS. 1 and 2 are designated with the same reference numerals.

A central bore 18 of the BHA carries mud from the drill pipe (arrow 16) down to the drill bit (arrow 17), as conventional. Surrounding the bore 18 is an annular cavity 19. Inlet port and one-way, pressure sensitive valve 14 are shown at the distal end of annular cavity 19, whilst outlet port and one-way valve 15 are shown at the proximal end. Arrows 20 indicate over-pressurized mud from region 12 entering the cavity 19 via port/valve 14 and arrows 21 indicate the mud exiting via port/valve 15 and thereby bypassing the pack-off 11.

In a modified embodiment, the outlet ports/valves 15 are omitted, in which case the cavity 19 is simply a volume for pressurized mud to enter, thereby providing very short term relief of the over-pressure to give the operator time to reduce mud pressure at the surface before taking action to remove the pack-off. The modified embodiment is in all other respects the same as the embodiment shown in FIGS. 2 and 3.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method of drilling into a rock formation, the method comprising:

(a) passing into the rock formation a drill string comprising a drill pipe, bottom hole assembly and drill bit, and thereby forming a wellbore in the rock formation;

(b) circulating drilling mud using mud pumps through the drill pipe, through a central bore in the bottom hole assembly and through the drill bit and back through an annular space defined between the drill string and wellbore;

(c) in the event of an obstruction, or pack-off, forming or beginning to form between the bottom hole assembly and wellbore, passing drilling mud into an annular internal cavity of the bottom hole assembly that surrounds the bore, said mud entering said annular cavity through an inlet valve in the bottom hole assembly at a location distal to the obstruction, in order to relieve pressure, wherein the inlet valve is opened in response to pressure;

(d) passing drilling mud out of the annular cavity through exit ports at a proximal end of the bottom hole assembly in a part of the bottom hole assembly that faces generally axially with respect to the drill string, wherein a flow path for drilling mud provided by the annular cavity is more restricted than a normal mud flow path, resulting in an increase in pressure detected at the surface; and (e) slowing said mud pumps in response to said detected pressure increase.

2. A method according to claim 1, wherein the inlet valve is arranged to open in response to one or more conditions selected from:

a predetermined pressure difference between the cavity and an exterior of the bottom hole assembly;

a predetermined rate of increase of pressure between the cavity and an exterior of the bottom hole assembly;

a predetermined pattern of pressure fluctuation between the cavity and an exterior of the bottom hole assembly; and a predetermined difference in pressure between two axially separated regions of the bottom hole assembly.

3. A method according to claim 2 wherein the inlet valve is arranged to open in response to a pressure greater than an expected maximum normal pressure of drilling mud distal of said obstruction wherein said pressure is selected from 10 to 1000 psi (69 kPa to 6,900 kPa) greater, 30 to 500 psi (210 to 3,400 kPa) greater, 50 to 200 psi (340 to 1,400 kPa) greater, and about 100 psi (690 kPa) greater.

* * * * *